United States Patent [19]

Miller

[11] 4,050,403

[45] Sept. 27, 1977

[54] AUTO REPAIR RAMP WITH SIGNAL

[75] Inventor: Jack V. Miller, Sierra Madre, Calif.

[73] Assignee: Acroform Corporation, Los Angeles, Calif.

[21] Appl. No.: 606,301

[22] Filed: Aug. 20, 1975

[51] Int. Cl.[2] ..... B66F 19/00

[52] U.S. Cl. ..... 116/124 R; 254/88

[58] Field of Search ..... 254/88, 5 B, 45; 248/352; 116/124 R, 28 R; D12/53; 340/282

[56] References Cited

U.S. PATENT DOCUMENTS

| | | | |
|---|---|---|---|
| 2,096,195 | 10/1937 | Nelson | 254/88 |
| 2,232,585 | 2/1941 | Aldrich | 254/88 |
| 3,178,156 | 4/1965 | Rigers | 254/88 |
| 3,638,910 | 2/1972 | Nellis | 254/88 |

FOREIGN PATENT DOCUMENTS

| | | | |
|---|---|---|---|
| 1,327,185 | 4/1963 | France | 254/88 |

*Primary Examiner*—S. Clement Swisher
*Assistant Examiner*—Denis E. Corr
*Attorney, Agent, or Firm*—John E. Wagner

[57] ABSTRACT

An automotive service ramp comprising a unitary body member including a ramp portion with integral side stiffening, tire retaining rails, a contoured rest portion to receive the tire of an automobile, and an extension beyond the rest portion which constitutes a leg portion.

The ramp portion has transverse corrugations, is contoured transversely to match normal tire cross sections and has depending stiffening sides. A slight edge rail extends above the surface of the ramp.

A handle is pivotally secured to the body in a position whereby it may be grasped to carry the ramp with the ramp portion hanging downward. The handle is pivoted to overlie the rest and leg portion when not in use and to be out of the way. An integral retainer portion of the body member holds the handle at a fixed position when not in use. The handle is so contoured that if it is left in an unsecured position and an automobile wheel ascends the ramp, the tire snaps the handle into its stored position without damage either to the handle or to the tire. The handle and the retainer portions cooperate whereby movement of the handle into its stored position produces an identifiable sound to inform the user that the handle is in place.

10 Claims, 11 Drawing Figures

AUTO REPAIR RAMP WITH SIGNAL

BACKGROUND OF THE INVENTION

The automobile service ramp has developed through the years from simply:

a. an inclined plane block with a flat portion made from large pieces of wood, for example, sections of railroad ties, to b. truss like structures, to c. my recent invention of the stamped, welded ramp disclosed in co-pending applications, Ser. No. 520,566, now Pat. No. Des. 239,610 and 503,947, now U.S. Pat. No. Des. 237,162.

The stamped automobile service ramp has several advantages including simplicity and reduction in cost, combined with additional safety. Because the ramp is of a single piece of metal, there is no danger of failure of the ramp by reason of failure of fastening devices such as loosening of bolts, shearing of rivets and the like, or improper assembly or maintenance by the user. To obtain sufficient strength in initial designs of stamped ramps, increased thickness material was required.

One other limitation on existing service ramps of all types has been the lack of any clear indication to the driver, while driving his vehicle up onto a ramp, that the tire has reached the final, desired position. Even stops which have been present at the end of the rest portion can easily be driven over and the vehicle driven off the ramp. This is particularly a problem with lower profile low pressure tires which do not give a feeling to the driver of striking any small stop or obstruction.

One other difficulty has been that ramps of the unitary type do not have handles which were present in the old truss type of ramps where any portion of the truss can be grasped to carry a ramp.

Typically stamped or formed ramps have employed flat cross section ramp surfaces with upstanding side walls. The side walls are intended as guides for the tires and to act like a truss on each side to give added strength.

BRIEF STATEMENT OF THE INVENTION

With the state of the prior art in mind, I have invented an improved stamped automobile service ramp in which the ramp portion conforms to the natural shape of the automobile or truck tire thereby distributing the load over a larger area. Further, the reinforcing side rails depend downward below the ramp surface whereby fibre stress and the liklihood of buckling of the ramp is significantly reduced. Additional stiffness has been obtained through the presence of longitudinal side rail portions extending normal to the conventional transverse rib stiffeners and constituting downward extensions of the vertical sides.

I have further developed an improved handle for such ramps which is conveniently located for carrying the folds out of the way in storage.

I have further developed a handle retaining means which is integral with the body to eliminate the need of additional parts.

I have coordinated the position and operation of the rest portion of the ramp with the handle and retaining means to automatic locking of the handle by the driving of a vehicle up the ramp.

I have further coordinated the design of these three elements whereby the mounting of a vehicle on ramp with a handle in its unstored position automatically stores the handle with a loud sound produced by coaction between the handle and its retainer to inform the driver that the wheel is in place.

BREIF DESCRIPTION OF THE DRAWINGS

The foregoing brief description may be more clearly understood from the following detailed description and by reference to the drawing in which.

DETAILED DESCRIPTION OF THE INVENTION

Figure 1:
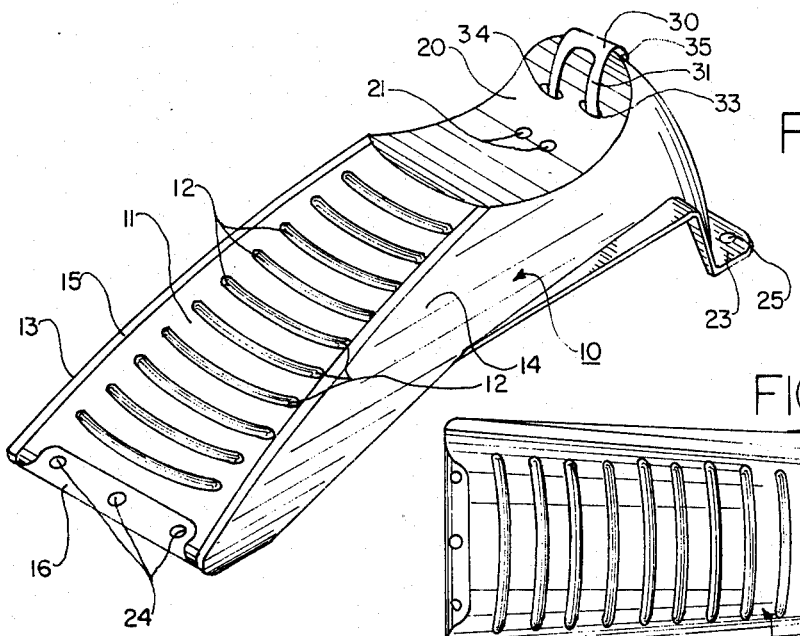
FIG. 1 is a perspective view of an automobile service ramp in accordance with this invention.
Figure 2:
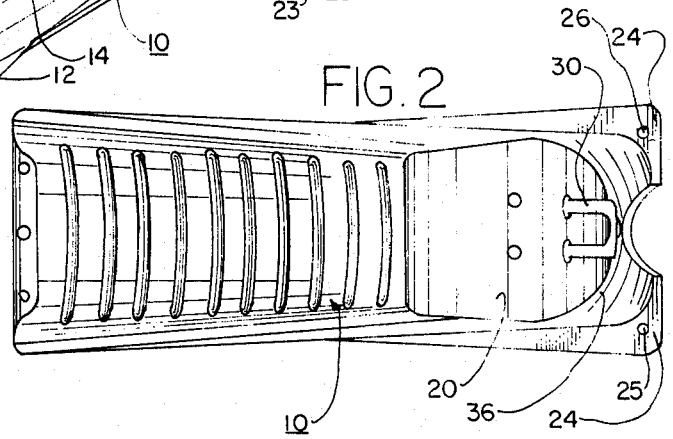
FIG. 2 is a top plan view thereof.

Now referring to FIG. 1, a ramp in accordance with this invention may be seen therein as comprising a unitary body member generally designated 10 including a ramp portion 11 having a number of ribbed corrugations 12 for promoting frictional contact between a tire rolled up the ramp, and also providing lateral stiffness for the ramp portion 11. At each side of the ramp portion 11 are sidewalls 12 and 13 respectively including integral formed extensions 14 and 15 which extend above the level of the ramp in the order of ½ inch to provide a degree of guidance to a wheel driving up the ramp portion from the entrance portion 16. The side rail extensions 14 and 15 also provide a more significant function in that they provide stiffness to the ramp portion 11 and longitudinal stiffness to the entire ramp assembly. At the end of the ramp portion 11 is a partial spherical rest portion 20 configured to receive an automobile or light truck tire. At the bottom of the rest portion are a pair of drainage holes 21 to allow any moisture captured in the rest portion 20 to drain away. At the rear of the rest portion 20 is an integral leg assembly 22 having a pair of feet 23 and 24 the latter which is best seen in FIG. 2. As described above, the basic ramp is a single unitary member made preferably from stamped steel in the order of 16 gauge. It may optionally include rubber or other resilient feet in mounting holes 24 and at the front or entrance portion 16, and 25 and 26 at the rear.

In addition to the unitary ramp assembly there is a feature added at the rear and extending into the rest portion 20 and over the rear wall. It is a handle 30 including a pair of arms 31 and 32 which extend through mating slots 33 and 34 in the unitary body member 10. The handle 30 includes an overhang portion 35 which is configured to slide along the rear wall 36 of the ramp under certain conditions as described below.

Figure 3:
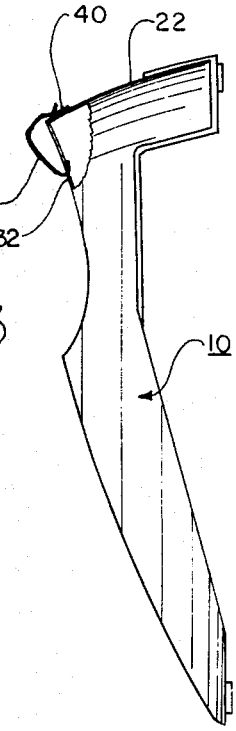
FIG. 3 is a side elevational view thereof with portions broken away for clarity.

The handle pivots about the ends of the arms 31 and 32 which pass through mating slots 33 and 34 in the rest portion 20 of the ramp body 10. The normal position of the handle 30 in carrying is illustrated in FIG. 3 with portions broken away for clarity. The interlocking of the lead portion 31 through the slot 32 is illustrated in this FIG. 3. Also integral with the support portion 22 of the body at the rear are corrugations 40. These corrugations 40 are formed as a primary or secondary operation in the stamping of the ramp body 10 and may be in the form of a plurality of grooves, bumps or other discontinuities in the surface. As apparent in FIG. 3, the handle 30 includes a protruding element 37 which is positioned such that pivoting of the handle 30 about the slot 32 will bring the protrusion 37 into engagement with the corrugation 40.

Figure 4:
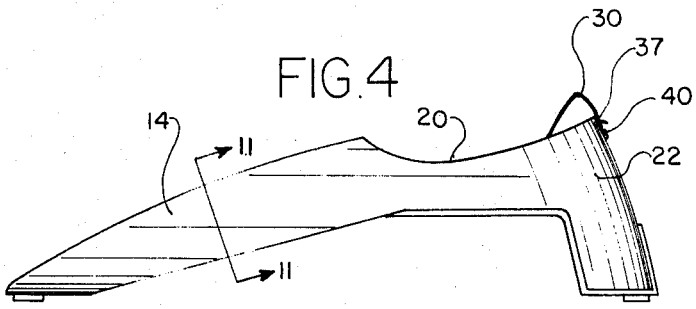
FIG. 4 PRIOR ART
FIG. 4 is a side elevational view of the ramp of this invention with an automobile wheel ascending the ramp.

Now referring to FIG. 4, a ramp is shown in its normal position with an automobile wheel 50 rolling up the ramp within the side rails 14 and 15, the tire of which appears as just about to enter the rest portion 20. The handle 30 is shown in its upright position with the corrugation 37 or the protuberance just above the grooves 40. The handle 30, as is apparent, is at the end of travel of the wheel 50 which will therefore, in a normal path of travel, compress and turn and rotate the handle 30 so that the protuberance 37 runs across the corrugation 40. The ramp, being made of sheet metal principally, and similarly the handle 30 of sheet metal or wire, as described below, has the effect of a grating of a metal member along a hollow metal sheet producing a distinct loud sound. Whenever the occupant of the vehicle is driving the vehicle up the ramp and bears that sound, he is signalled that the wheel has reached the rest portion 20 and that he should advance no further. If perchance he proceed further, the sloping rear wall and the conformance of the handle 30 to the body of the ramp assures that no damage is done whether to the ramp or the vehicle. It is clear though, that the audible indication given by the movement of handle 30 is sufficient and clear warning to the user. Also, the handle movement from the set to the stored position as shown in FIG. 4, to the stored position, is a visual indication to someone alongside of the vehicle that the wheel is in position. It is also apparent in FIG. 1 that the rest portion of the ramp is partially hemispherical. Therefore, the vehicle up on the ramp may have its wheels turned without tipping the ramp or falling off the ramp.

Figure 6:
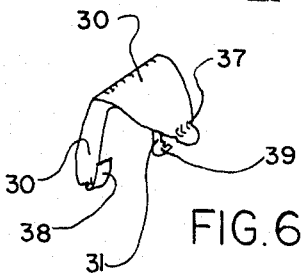
FIG. 6 is a perspective view of the preferred handle of this invention.

Now referring to FIG. 6, each of the details of the handle 30 may be seen including the two arms 30 and 31 and their ends which engage the ramp. The handle 30, being made of flexible sheet metal, may be bent slightly to assemble it with the ramp body 10. Under those circumstances, the ends 38 and 39 may be formed with an edge slot to allow a degree of locking of the ends 38 amd 39 into their respective slots.

Figure 8:
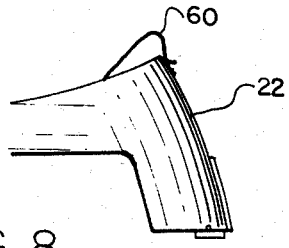
FIG. 8 is a fragmentary side elevational view of a ramp employing a handle of FIG. 7.
Figure 9:
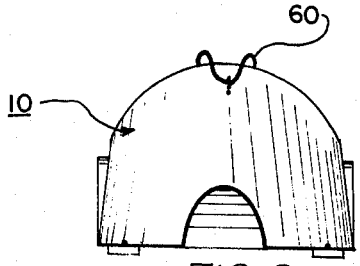
FIG. 9 is a rear end view of the ramp employing the handle of FIG. 7.
Figure 7:
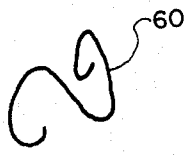
FIG. 7 is a perspective view of an alternate handle configuration.

An alternate embodiment of the handle 30 is shown as handle 60 appearing in FIG. 7, apart from the assembly, and in position in FIGS. 8 and 9. A wire formed handle 60 will operate in the same manner as a sheet metal handle 30 shown in FIGS. 1-6.

Figure 10:
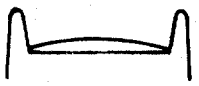
FIG. 10 is a cross section of a typical prior art ramp in the inclined or ramp portion.
Figure 11:
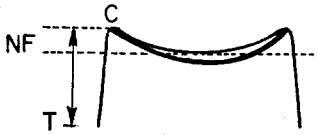
FIG. 11 is a cross section of a ramp in accordance with this invention taken along line 11—11 of FIG. 4.
Figure 5:
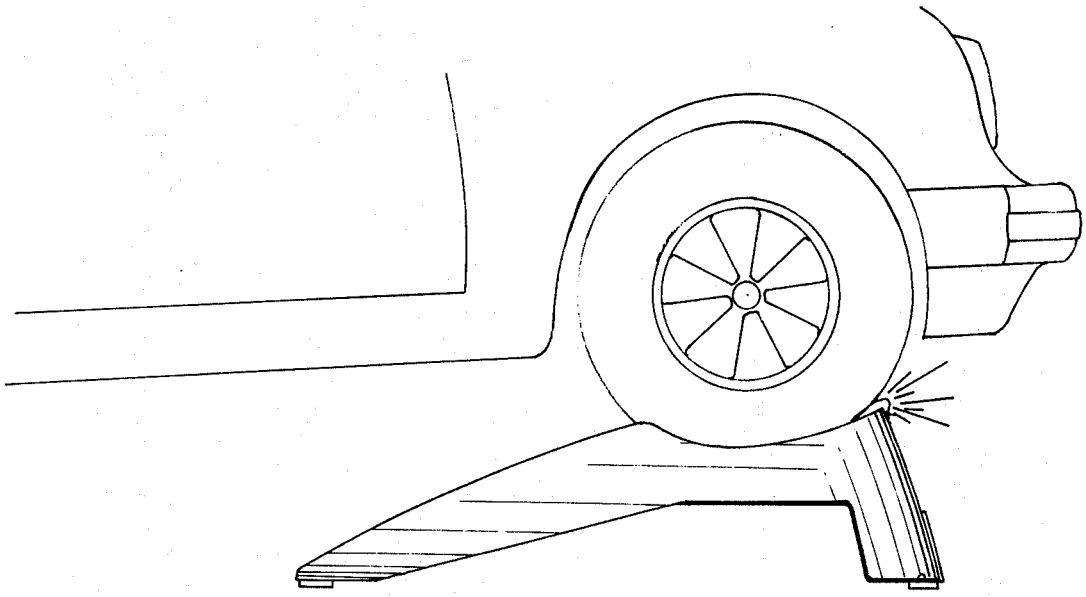
FIG. 5 is a view similar to FIG. 4 with the automobile wheel in place.

As briefly described above, the ramp of this invention is believed to involve several remarkable advances over the prior art, not the least of which is illustrated in FIG. 11 by comparison with FIG. 10 which is representative of the prior art.

With the advent of my truly unitary stamped ramp, the danger of ramp failure due to fastener failure was eliminated. This left the principal mode of failure to be in buckling of the ramp portion. This was avoided in all ramp designs by three features illustrated in FIG. 10, namely the use of:

a. transverse ribs 120;
b. longitudinal ribs 150; and
c. heavy guage ramp material, e.g. 14 guage or heavier.

The transverse corrugations 120, similar to corrugations 12 of FIGS. 1 and 2, provide resistance to bending failure in a transverse plane to the direction of movement of a wheel on entering the ramp. They also provide traction elements. Longitudinal ribs 150 and 140 have an apparent similarity to the ribs 14 and 15 of the ramp of this invention. They are designed to give longitudinal strength to the ramp and guide the tire to prevent it running off the ramp portion.

I have found that the side rails 140 and 150 do not restrain an off center tire but only serve to put a side load in the direction of the arrow in FIG. 10 to the rib 140 which is loaded in compression at its apex. Side loading plus the concentration of compressive loading on the side rail 140 tends to cause buckling. The solution has been to add thickness to the ramp as a whole until the ramp exhibits sufficient strength to provide a usable ramp, e.g. a rated safe load of 2,500 pounds per ramp.

I have found that a far superior ramp may be produced employing:

1. transverse ribs;
2. a longitudinal rib which extends above the level of the transverse ribs only sufficient to eliminate the transverse ribs as discontinuities at the edges of the ramp portion;
3. a depending skirt below each side rail at least three times the average distance from the neutral fibre of the cross section than the upstanding rail;
4. transverse and longitudinal ribs tapered to 0 level at their ends; and
5. the inboard and outboard faces of the longitudinal ribs a slight draft in the order of 3°-50° from the vertical.

Each of the features 1, 2, 3, and 5 are illustrated in FIG. 11 and the feature 4 appears in both FIGS. 1 and 2. FIG. 11 shows that the longitudinal ribs 14 and 15 extend only slightly above the surface of the curved ramp portion 11 but the skirt portions **14*a* and 15*a* extend well below the level of the ramp surface and at least three times the distance from the neutral fiber, denoted by the dashed line NF of FIG. 11.**

The neutral fiber as used herein constitutes a fiber or material located on the neutral surface or neutral axis of the beam under load. The neutral surface is well defined in classic engineering texts such as Fuller & Kerekes, Analysis and Deisgn of Steel Structures, D. VanNosterand Co., Inc. NYNY, 1933, pg. 56, where it is stated "between the concave the convex surface of a loaded beam, there is a surface in which the fibers do not change in length. This surface is called the neutral surface."

The virtually continuous curved ramp portion 11 and side rails 14 and 15 distribute the load of the tire while ascending the ramp and thereby drastically reducing the unit load on the ramp. Likewise, the curved ramp portion 11 tends to self center the tire effectively and thereby actually does minimize drive off of the side of the ramp.

As a result of the addition of each of these features above, I have achieved a ramp having a safe rated load of 3000 pounds as opposed to 2,500 pounds while using thinner gauge material, namely a 16 gauge at a material savings of approximately 24%.

The above described embodiments of this invention are merely descriptive of its principles and are not to be considered limiting. The scope of this invention instead shall be determined from the scope of the following claims, including their equivalents.

What is claimed is:

1. An automobile service ramp comprising a unitary sheet metal body member including a ramp portion, a wheel rest portion and a support portion;

said ramp portion having a concave track portion having a number of transverse extending corrugations, and a pair of integral ribs extending longitudinally with respect to said ramp portion along each side thereof;

said longitudinal ribs upstanding above the level of the transverse corrugations and said longitudinal ribs including depending extensions constituting continuations of said longitudinal ribs having a length below the neutral fiber of a cross section of the ramp portion at least three times the maximum distance of the longitudinal rib above the neutral fiber; and wherein said rest portion is a surface that is in the form of a portion of a sphere.

2. An automobile service ramp comprising a unitary sheet metal body member including a ramp portion, a wheel rest portion and a support portion;

said ramp portion having a concave track portion having a number of transverse extending corrugations, and a pair of integral ribs extending longitudinally with respect to said ramp portion along each side thereof;

said longitudinal ribs upstanding above the level of the transverse corrugations and said longitudinal ribs including depending extensions constituting continuations of said longitudinal ribs having a length below the neutral fiber of a cross section of the ramp portion at least three times the maximum distance of the longitudinal rib above the neutral fiber;

including handle means pivotally secured to said ramp in the rest portion;

wherein said handle is positioned whereby the movement of a tire on to the rest portion of said ramp moves said handle to a stored position.

3. An automobile service ramp comprising a unitary sheet metal body member including a ramp portion, a wheel rest portion and a support portion;

said ramp portion having a concave track portion having a number of transverse extending corrugations;

a pair of integral ribs extending longitudinally with respect to said ramp portion along each side thereof;

said longitudinal ribs upstanding above the level of the transverse corrugations and said longitudinal ribs including depending extensions constituting continuations of said longitudinals ribs having a length below the neutral fiber of a cross section of the ramp portion at least three times the maximum distance of the longitudinal rib above the neutral fiber;

including handle means pivotally secured to said ramp in the rest portion;

wherein said handle means includes a portion engagable with an audible sound upon movement to a stored position.

4. The combination in accordance with claim 3 wherein said ramp includes at least one discontinuity in the path of movement of said handle to stored position, said handle including a portion audibly engaging said discontinuity of said ramp.

5. The combination in accordance with claim 4 wherein said discontinuity is located in the support portion.

6. The combination in accordance with claim 4 wherein said discontinuity constitutes at least one external protrusion.

7. The combination in accordance with claim 6 wherein said handle snaps over said protrusion and is retained thereby in a stored position.

8. A service ramp comprising an inclined ramp portion, a rest portion for holding a vehicle wheel and a support portion for one end of said rest portion;

indicator means secured to said ramp;

said indicator means movable from a first to a second position with respect to said ramp by the movement of a vehicle wheel to the desired rest position;

said indicator means and said ramp cooperating to provide an audible indication of movement of said indicator means; and said indicator means in rotatable to said first position whereupon said indicator means constitutes a handle for lifting of said ramp.

9. A vehicle repair ramp comprising a unitary sheet metal body including an inclined ramp portion having a supporting foot at one end and terminating at the opposite end in a recessed rest portion for holding a vehicle wheel, said rest portion terminating at its end opposite the said ramp portion in a leg portion;

the supporting foot of said inclined ramp portion and said leg portion constituting the sole support for said ramp and rest portions;

said ramp portion including a plurality of integral transverse ribs and a pair of longitudinal ribs, one of said longitudinal ribs located on each side of said ramp portion;

said longitudinal ribs each having an integral depending skirt portion having a length below the neutral surface of the beam formed by said ramp portion at least three times the distance of said longitudinal ribs above said neutral fiber.

10. The combination in accordance with claim 9 wherein said longitudinal and transverse ribs taper to "0" height at their respective ends.

* * * * *